United States Patent [19]

Krason et al.

[11] Patent Number: 4,529,183

[45] Date of Patent: Jul. 16, 1985

[54] METHOD OF MACHINING AND VISE FOR USE THEREIN

[76] Inventors: Robert P. Krason, 529 Whitestown Rd.; James P. Chick, R.D. #3, both of Butler, Pa. 16001

[21] Appl. No.: 443,464

[22] Filed: Nov. 22, 1982

[51] Int. Cl.[3] ..... B25B 1/10

[52] U.S. Cl. ..... 269/43; 269/136; 269/240; 269/247

[58] Field of Search ..... 269/43, 136, 138, 154, 269/240, 247, 906, 152, 153, 242

[56] References Cited

U.S. PATENT DOCUMENTS

| | | | |
|---|---|---|---|
| 307,439 | 11/1884 | Corbett | 269/152 |
| 3,397,880 | 8/1968 | Kuban | 269/240 |
| 3,861,664 | 1/1975 | Durkee | 269/43 |
| 4,205,833 | 6/1980 | Lenz | 269/247 |

*Primary Examiner*—Frederick R. Schmidt
*Assistant Examiner*—Judy J. Hartman
*Attorney, Agent, or Firm*—John W. Linkhauer

[57] ABSTRACT

To make parts requiring machining with the workpiece vise-held in different orientations, there is provided a precision vise having first and second pairs of jaws, each pair having a member which is fixedly located with respect to a reference location. The invention includes use of a particular form of vise for holding two pieces whereby the screw shaft that rotates to open or close the jaws is tensioned during tightening, which improves accuracy by avoiding bending stresses. When used in conjunction with suitable numerical-control equipment, the vise of the invention greatly increases productivity in the machining of product parts of the kind indicated above.

5 Claims, 3 Drawing Figures

METHOD OF MACHINING AND VISE FOR USE THEREIN

BACKGROUND OF THE INVENTION

I. Field of the Invention

This invention relates to a method of machining workpieces and to a form of vise for use therein.

II. Description of the Prior Art

In the art of machining workpieces, it is known that there is numerical-control equipment which makes it possible to produce large numbers of identical pieces in a given amount of time, with any desired features (drilled or bored holes, milled or shaped slots, chased threads, etc.) being produced rapidly, accurately, and errorlessly, and with a minimal generation of scrap. A workpiece which is to be machined is positioned accurately within a vise, and then the numerical-control equipment takes over, bringing against the piece to be worked upon the necessary and appropriate tools for performing the desired machining operation or operations. The numerical-control equipment is, of course, largely limited to performing operations upon a face of the workpiece which is presented towards the tool or tools to be used. Whenever the piece which is to be made is such that all of the required operations can be done upon just one face of the workpiece, the numerical-control equipment and the precision vises known in accordance with the prior art usually yield very satisfactory results. The numerical-control equipment is suitably programmed so that the necessary operations are done in a predetermined sequence, and after the equipment has gone through one cycle of its operation, one finished piece is removed.

There are, however, some product pieces which need to be made by working with tools being brought to bear first upon one side or face of the workpiece and then upon an adjacent or an opposite face of the workpiece.

While a workpiece is being worked upon, it needs to be securely held, and this means that, at the least, the sides or faces thereof which are presented towards the vise or other means within which the workpiece is held are unavailable for being worked upon.

Thus, even with some relatively expensive and sophisticated numerical-control equipment, equipment which is capable of machining a piece from the front, the back, and the top thereof, the sides which are presented towards the vise are not available for machining without removing the piece from the equipment and later conducting a separate operation. More often, the numerical-control equipment is even simpler and less sophisticated, being able to machine only the front or only the front and the top; if there are things to be done to any pair of opposite faces of the workpiece, it takes two set-up operations to get the numerical-control equipment to make the desired product piece.

Moreover, there is the problem that pieces which have been subjected to the first operation need to be stored or stockpiled for as long as the first operation is being conducted. It is desirable, of course, to spend a minimum of time upon the changeover from doing the first operation to doing the second, or vice versa, but with the equipment and methods available prior to the present invention, it has usually been necessary to have such changeovers, back and forth, at rather frequent intervals, because of having only a limited amount of space available for storage of partly finished pieces.

There has distinctly been a need for a method and equipment such that it is possible, when desiring to make a product piece which requires machining directed at more than one face of the workpiece which is to be machined, to insert into the numerical-control equipment a pair of pieces, one having a first orientation and another having a second and different orientation, so that when the numerical-control equipment is permitted to go through one cylce of operation, it performs, in effect, the complete machining of a piece, doing the first half of what is necessary to one workpiece while doing the second half of what is necessary to its vise-mate. This greatly improves the productivity of the numerical-control equipment. What is needed is a suitable precision vise which has the capability of holding not one workpiece but two. There has not hitherto been available to the metal working art, to the applicants' knowledge, any suitable two-piece-holding precision vise for use with numerical-control equipment. Various forms of precision vises are commercially available, but none of the commercially available vises is as suitable as that of the present invention.

It might appear that the problem could be solved with the use of a precision vise adapted to hold one object in such a way that it holds two workpieces which are differently oriented, either with a suitable jig or fixture in the nature of a spacer there between, or even merely with one workpiece pressed against another one which is differently oriented. As is well appreciated by those skilled in the art, such an approach does not yield satisfactory results, since it does not provide for having the pieces which are being machined suitably located with respect to a reference point. Any deviation in the desired dimension through which the workpiece is being held, of one piece, the other piece, or of both, will cause undesirable deviations in the location of the features being machined into both workpieces.

The precision vises which are now commercially available have a drawback, in that when the vise is in operation, the shaft which has on its exterior the jaw-advancing screw is put into compression, rather than into tension, when the jaws are being tightened. Putting the screw shaft into compression introduces bending forces which tend to cause the screw shaft and the base both to become bowed, which is a source of inaccuracy. It is desirable that the screw shaft be pulled straight and not pushed into bowing.

Those familiar with the arts of building and using precision vises are familiar with the concept, shown in the expired Muggli, et al., U.S. Pat. No. 2,880,638, of using a hemispherical segment inserted between the jaw-advancing nut and the jaw bit to which the jaw plates are attached, in order to obtain a self-alignment feature.

The idea, in the art of precision vises, for being able to mount jaw plates selectively on either of two mounting faces of the jaw, in order to be able to accomodate pieces of different overall length, is shown in U.S. Pat. No. 3,397,880.

BRIEF SUMMARY OF THE INVENTION

To make parts requiring machining with the workpiece vise-held in different orientations, there is provided a precision vise having first and second pairs of jaws, each pair having a member which is fixedly located with respect to a reference location. The invention includes use of a particular form of vise for holding two pieces whereby the screw shaft that rotates to open or close the jaws is tensioned during tightening, which improves accuracy by avoiding bending stresses. When used in conjunction with suitable numerical-control equipment, the vise of the invention greatly increases productivity in the machining of product parts of the kind indicated above.

DESCRIPTION OF THE DRAWINGS

A complete understanding of the invention may be obtained from the foregoing and following description thereof, taken in conjunction with the appended drawings, in which.

A DESCRIPTION OF THE PREFERRED EMBODIMENTS

Figure 2:
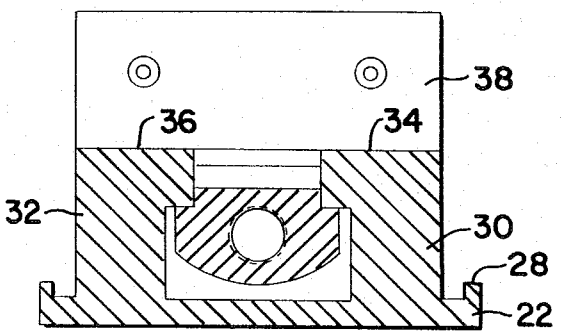
FIG. 2 is a sectional view, taken on the line II—II in FIG. 1.

In the precision vise according to the invention, there is a screw shaft 2, which has at a proximate end thereof a portion 4 which is square in cross-section and serves for the joining of the screw shaft 2 to a handle 6. Immediately adjacent to the portion 4, there is a portion 8 of slightly reduced diameter which provides a seat for a snap ring 10. The screw shaft 2 further has means 12 such as an integral portion of increased diameter which serves, as will be explained in greater detail hereinbelow, to bear against a slide member 14, for purposes which will also hereinbelow be more fully explained. The screw shaft 2 further has in the vicinity of its distal end 16 a portion 18 which is provided with suitable threads, by means of which the screw shaft 2 may be threadedly engaged with a second slide member 20.

Figure 1:
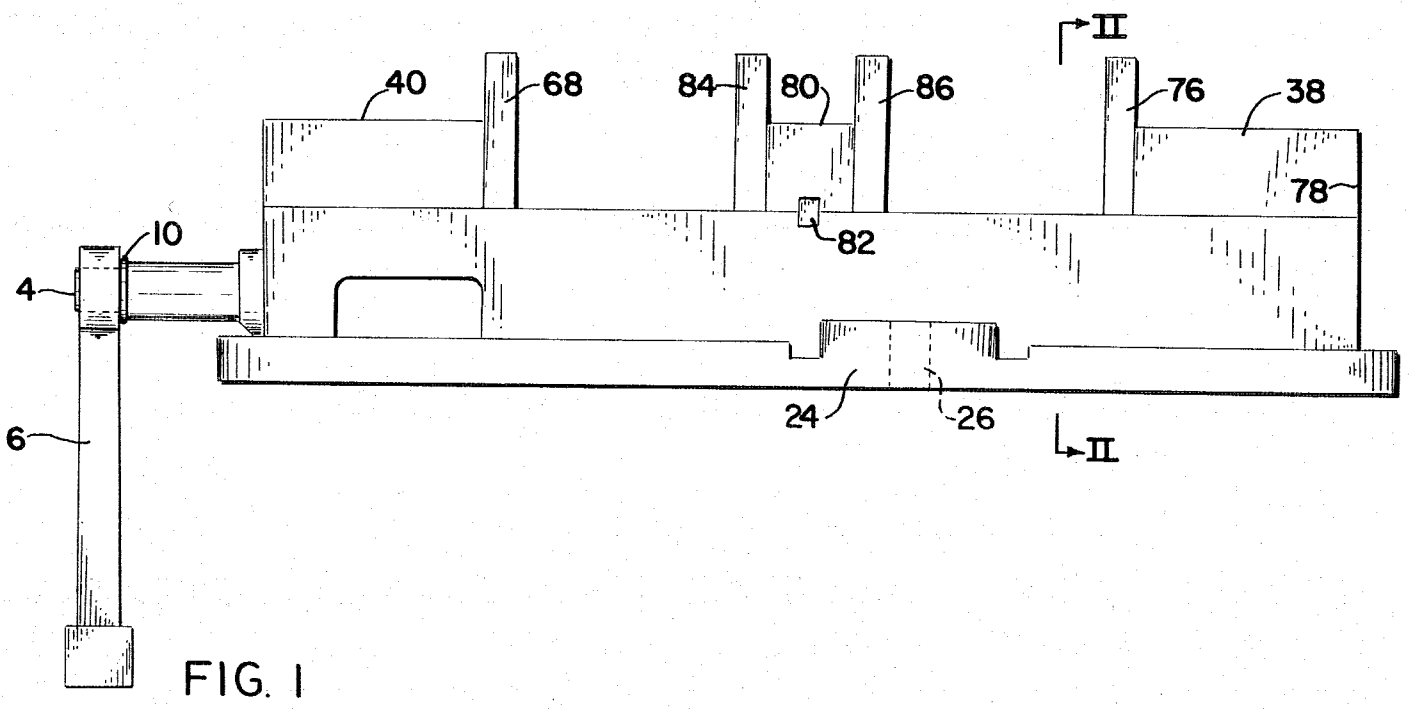
FIG. 1 is a front elevation view of a precision vise made in accordance with the invention, for use in the practice of the method of the invention.
Figure 3:
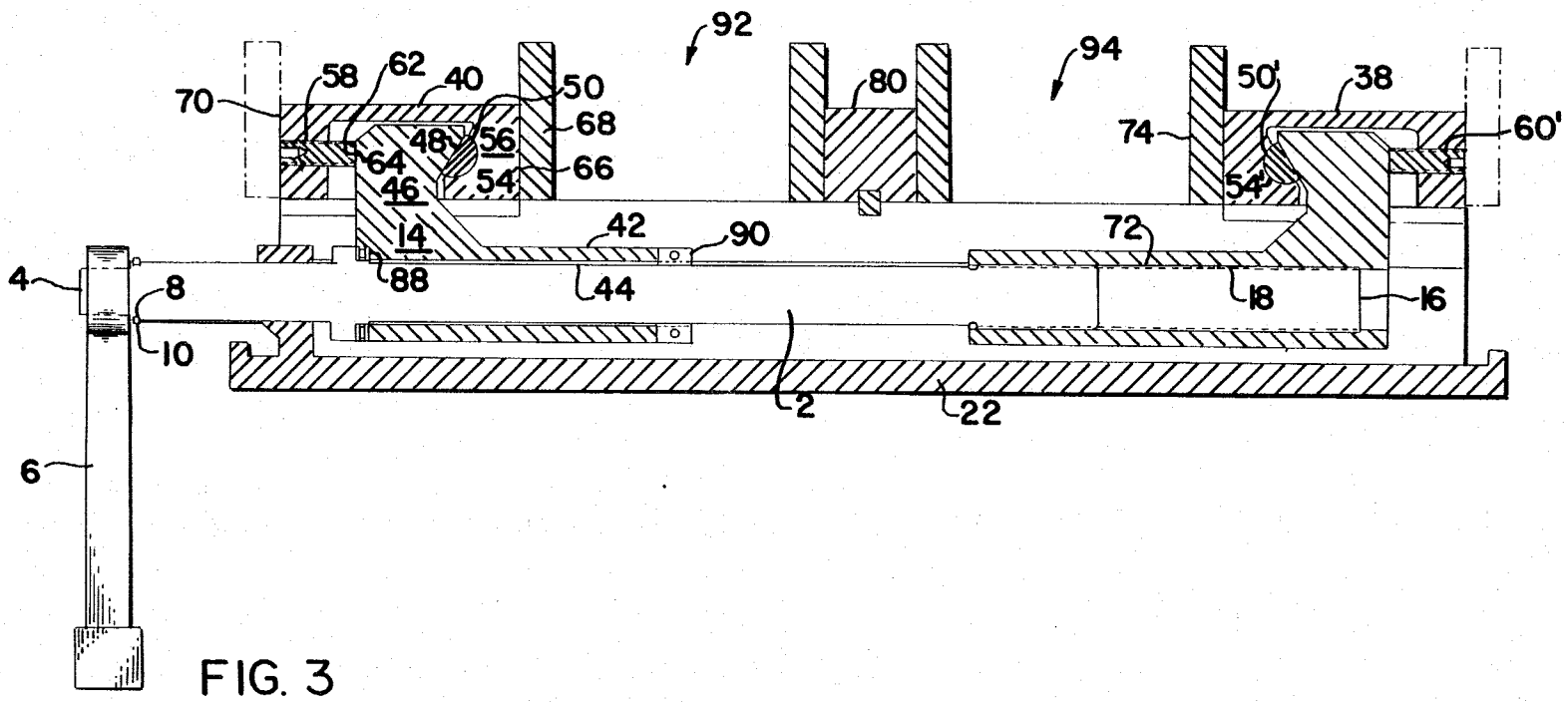
FIG. 3 is another sectional view, taken on the line III—III in FIG. 2.

The precision vise according to the invention also contains a base member 22. The base member 22 has a pair of ear portions 24 (only one of which is visible in FIG. 1), which portions 24 contain passing vertically therethrough bores 26 by means of which the vise may be accurately and fixedly positioned in a place of use, such as within suitable numerical-control machining equipment. The base 22 contains, in addition to its horizontally extending bottom portion, upstanding margin portions 28 and also additional, more massive upstanding portions 30 and 32, which extend substantially for the entire length of the vise and serve, by means of their top portions 34 and 36, respectively, as loci for the sliding movement lengthwise of the vise of movable jaw members 38 and 40, which are engaged by the slide members 14 and 20.

The slide 14 has a collar portion 42 which contains a bore 44 that is of such interior diameter as to permit the screw shaft 2 to be passed therethrough. The slide 14 also contains a somewhat massive upper portion 46 which has a bearing surface 48 which forms a suitable angle with the perpendicular and which bears against a hemispherical segment 50 formed of hardened steel or the like. The segment 50 has an exterior convexly spherical surface 52 which bears against a concavely hemispherical seat 54 located in a suitably angularly matching part 56 of the jaw member 40.

The jaw member 40 has therein a threaded bore 58, through which there is passed a setscrew 60, the end 62 of which bears against a portion 64 of the slide number 14. The setscrew 60 may be adjusted to take up wear. The slide member 14 has a face 66, to which a jaw plate 68 may be suitably attached by means (not shown).

It is desirable for the apparatus to include provision whereby the jaw plate 68 may be positioned against the face 70 of the jaw member 40, instead of being secured to the face 66, in order to accomodate for the holding of larger pieces.

In general, the slide 20 is similar in its construction to the slide 14, except that it contains a internally threaded tubular portion 72 which is adapted to receive the distal end 16 of the screw shaft 2. The jaw plate 74 is likewise preferably capable of being secured, by means (not shown), either to the face 76 or to the face 78 of the jaw member 38.

Centrally located in the structure defined above, there is a central fixed jaw 80, which is keyed to the body or base member 22 as at 82 and has fixed jaw plates 84 and 86 attached thereto.

The structure described above may be assembled in the following manner. First, a thrust bearing 88 is slipped onto the shaft 2 and up against the means 12, and then the shaft 2 is inserted through the bore 44. Thereafter a two-piece thrust collar 90 is installed on the screw shaft 2. Then, this entire assembly is caused to slide into the vise base 22 from the side which is the left-hand side in FIG. 1. Then, a snap ring 10 is installed into the reduced diameter portion 8 of the screw shaft 2. Then, the slide 20 is inserted into the side of the vise which is the right-hand side in FIG. 1, and while the screw shaft 2 is rotated, the end 16 is threaded into the part 72 of the slide 20. This is done to a suitable extent, such as approximately twelve revolutions after thread engagement.

Then, the concave spherical seats 54 and 54' are greased, and hemispherical segments 50 and 50' are inserted therein.

Next, the setscrews 60 and 60' are installed, care being taken not to let the setscrews 60 and 60' protrude into the cavity in the movable jaw members 38, 40.

Then, the movable jaw members 38 and 40 are lowered over the slides 14 and 20 so that the bottom faces of the jaw members 38 and 40 come into contact with the top of the vise base 22. Then the setscrews 60 and 60' are tightened until the proper amount of running clearance is obtained in the jaw members 38 and 40. Finally, the central fixed jaw 80 is installed to complete the assembly of the structure.

Those skilled in the art will readily understand how to use the structure described above to achieve the machining of workpieces in numerical-control equipment, and particularly, the machining of workpieces which require for their manufacture first and second cycles with the workpiece being in a different orientation in the second cycle than in the first. Once that a vise of a kind described above has been suitable secured in a suitably programmed numerical-control machining apparatus, it is possible to arrange first and second workpieces with different orientations in the openings 92 and 94 which are provided, and then turn the handle 6 to cause the jaws 38 and 40 to close in upon and grasp the workpieces to be secured. In this process, the screw shaft 2 moves axially as much as is required. The numerical-control equipment is then caused to go through one cycle of operation, and the workpiece in space 94 is moved to space 92 with a different, appropriate orientation, a new workpiece is inserted in the space 94 in the appropriate orientation for a workpiece which is inserted in that location, and the numerical-control equipment is put through another cycle of operation, thereby yielding in the space 92 a finished part which has been subjected to two machining operations, but with different orientation. This procedure may be repeated until all the parts have been machined, with the workpiece removed from the space 92 at the end of the first machining operation being given its turn in the space 94 at the end of the production run. With this manner of holding the workpieces subjected to machining in the numerical-control equipment, each cycle of the numerical-control equipment produces a finished part, except the first cycle, which does not yield any, and the last cycle, which yields two.

It is an important characteristic of the vise of the invention that its fixed central jaws provide a fixed central reference point. The value of this feature, in performing accurate machining with the use of numerical-control equipment, can hardly be overemphasized. The present invention, which is in its broadest aspects a vise with two pairs of jaws that have members from each pair that are spaced from a fixed reference point, provides for the first time, in the art of high-speed numerical-control machining of workpieces, a satisfactory way of obtaining machine features which are accurately located within or upon each of two workpieces which are being machined in one cycle of operation of the machine.

The vise and the method of the present invention stand in contrast to the conceivable practice of trying to machine two workpieces that are held within a single pair of jaws, either being held apart with the use of a spacer piece or not, i.e., with the use of two pieces merely being contiguously juxtaposed. If, for example, one of the workpieces is 0.005 inch wider than it should be, then this simply throws everything off. A vise with a single pair of jaws has a closed position which coincides with its reference plane. If such a vise is once accurately positioned and affixed within numerical-control equipment, a single piece held within it can, regardless of variations from the desired dimension of the workpiece in the dimension which governs the opening and closing of the precision vise, call it the x dimension, be provided with features which are accurately located with respect to each other or one another in respect to the x dimension, and there is no influence whatever on the accuracy of location and features on some other workpiece. When the same single pair of jaws is used to hold two workpieces, however, and the two workpieces have, let us say, different orientations, and one of the workpieces is 0.005 inch too large in the x dimension, then (a) on the piece which is too large, although all of the features are consistently located with respect to one another, they are not centered in relationship to the actual x dimension of the workpiece as they would have been if the piece had been machined by itself, using a single-jaw vise, but are all 0.0025inch off from that location, and (b) all the features on the second workpiece are consistent with one another but are displaced to locations 0.0025 inch farther along the x dimension than they would otherwise be. For some purposes, this may be tolerable, but for many purposes, it is not. It is preferable for each piece to be grasped independently by a pair of jaws, at least one of which has a known location in respect to a reference plane. This effect is obtained with the use of a vise according to the present invention.

While we have shown and described herein a certain embodiment of our invention, we intend to cover as well any change or modification therein which may be made without departing from its spirit and scope.

We claim as our invention:

1. A precision vise adapted to hold two workpieces, each located precisely with respect to a fixed reference location, said vise comprising a base, means located centrally of said base and fixedly connected thereto for holding a first jaw member which comprises a part of a first pair of jaws and a second jaw member which comprises a part of a second pair of jaws, a screw shaft journaled for rotation within said base, means for turning said screw shaft, a first slide member having therein a bore whereby said first slide member is internally traversed by said screw shaft, said slide member being operatively connected with a third jaw member with which said first jaw member comprises a part of said first pair of jaws, said screw shaft having means thereon which bear against said first slide member, and a second slide member having herein a bore whereby said second slide member is threadedly connected with said screw shaft, said second slide member being operatively connected with a fourth jaw member which with said second jaw member comprises a part of said second pair of jaws, said second slide member closing upon a first workpiece upon rotation of said screw shaft, and thereafter upon further rotation of said screw shaft, said bearing means on said screw shaft engages said first slide member, causing said third jaw member to close upon a second workpiece.

2. A vise as designed in claim 1, further characterized in that between said first slide member and said third jaw member and between said second slide member and said fourth jaw member, there are positioned hemispherical segment members suitably seated in inclined surfaces in said third and fourth jaw members to provide a self-aligning feature.

3. A precision vise as defined in claim 2, further characterized in that said third and fourth jaw members each have associated with them jaw plates which are selectively mountable against opposed mounting faces on said third and fourth jaw members so as to permit the grasping of pieces of different size.

4. A precision vise which is of such construction that its screw shaft is put into tension upon tightening, said vise being capable of grasping two workpieces and said vise comprising, in combination, a screw shaft having in a first end thereof a threaded portion and in a second and opposite end thereof a means for connecting said screw shaft to means for rotating said screw shaft, means for rotating said screw shaft operatively connected to said second end of said screw shaft, a base, said base having therein means for supporting said screw shaft in such manner as to permit rotational and axial translational movement thereof, a first jaw member operatively connected to said threaded portion of said screw shaft, and a second jaw member which is operatively associated with a member containing a bore traversed by said screw shaft, said screw shaft having thereon means for imparting force closingly urging said second jaw member towards said first jaw when said screw shaft is rotated in such a sense as to cause said vise to close, and a two-faced fixed jaw member affixed to said base at a location between said first and second jaw members, said first jaw member closing upon a first workpiece upon initial rotation of said screw shaft, and thereafter upon further rotation of said screw shaft, said force imparting means on said screw shaft engages said bore-containing member, causing said second jaw member to close upon a second workpiece.

5. A vise as defined in claim 4, further characterized in that said first and second jaw members are each operatively associated with said screw shaft by means including in each case a hemispherical segment, angularly inclined means in said first and second jaw members wherein said segment is seated, and parts contiguous to said screw shaft having downward facing angular surfaces which bear against flat surfaces of said hemispherical segments such that tightening of said vise simultaneously imparts closing and downward forces unto said first and second jaw members.

* * * * *